US005425633A

United States Patent [19]

Cole

[11] Patent Number: 5,425,633

[45] Date of Patent: Jun. 20, 1995

[54] FLOATING COMBUSTION APPARATUS

[76] Inventor: Michael C. Cole, 1382 Mountain Overlook Ct., NE., Marietta, Ga. 30066

[21] Appl. No.: 314,725

[22] Filed: Sep. 29, 1994

[51] Int. Cl.[6] ..... F23D 3/16; F23D 3/24

[52] U.S. Cl. ..... 431/291; 431/298; 431/320

[58] Field of Search ..... 431/320, 323, 325, 298, 431/291, 293, 301, 290; 362/159, 161

[56] References Cited

U.S. PATENT DOCUMENTS

| | | | |
|---|---|---|---|
| 397,011 | 1/1889 | Leynen-Hougaerts . | |
| 622,983 | 4/1899 | Tatham . | |
| 643,097 | 2/1900 | Adam . | |
| 1,184,511 | 5/1916 | Bourgeois . | |
| 3,428,409 | 2/1969 | Sommers | 431/289 |
| 4,013,397 | 3/1977 | Neugart | 431/320 X |
| 4,017,729 | 4/1977 | Frazier, Jr. . | |
| 4,084,086 | 4/1978 | Bandel . | |
| 4,134,718 | 1/1979 | Kayfetz et al. . | |
| 4,234,303 | 11/1980 | Neugart . | |
| 5,193,994 | 3/1993 | Schrineker . | |

FOREIGN PATENT DOCUMENTS

| | | | |
|---|---|---|---|
| 9818 | 8/1880 | Germany | 431/298 |
| 34832 | 8/1985 | Germany | 431/298 |
| 3700791 | 7/1988 | Germany | 431/298 |
| 542948 | 2/1942 | United Kingdom | 431/298 |
| 2204120A | 11/1988 | United Kingdom . | |

*Primary Examiner*—Carl D. Price
*Attorney, Agent, or Firm*—Richard C. Litman

[57] ABSTRACT

A combustion apparatus that comprises a floatable combustion device which rests atop the surface of a mass of fuel such as solid paraffin or a quantity of liquid fuel such as liquid paraffin or vegetable oil contained within a fuel vessel. The combustion device has a substantially conical top member and a bottom ballast member each fabricated of a thermally conductive material that serve to both melt solid fuel and heat the liquid fuel being supplied to the flame with an interior wick. Supporting this wick is a conical buoyant member that allows the device to float when positioned in liquid fuel or in melted solid fuel.

16 Claims, 3 Drawing Sheets

FLOATING COMBUSTION APPARATUS

BACKGROUND OF THE INVENTION

1. Field of the Invention

The present invention relates to a combustion device, and more particularly to a combustion device used in conjunction with solid or liquid fuel contained in a vessel.

2. Description of the Prior Art

Combustion devices have long been used to provide both heat and illumination. Traditionally, conventional candles constructed of solidified paraffin having a textile wick extending therethrough were used to provide this needed heat and illumination. These candles, however, tend to be messy, the candles often burning unevenly or becoming extinguished and wax dripping down the candles to solidify on supports for the candles. Moreover, the flames produced by these conventional candles are not adjustable, the amount of heat and illumination supplied by the candle being fixed, for the most part.

To remedy these shortcomings of the conventional candle, alternative combustion devices have been created that float atop solid or liquid fuels such as paraffin that provide even burning and reduce the wasting of unused fuel. While several such combustion devices are known, none has provided high efficiency and convenient adjustability of flame intensity.

One such combustion device is shown in U.S. Pat. No. 397,011 issued Jan. 29, 1889 to Jean Antoine Hubert Leynen-Hougaerts. In this patent, a lamp is described that utilizes a capsule which floats atop the surface of vegetable oil contained in a tubular vessel. The capsule, as described in the specification, is preferably fabricated of glass and has a central tube through which small quantities of the oil may pass for combustion. The capsule is weighted such that the level of the oil surface will be flush with the upper edge of the central tube, assuring sufficient supply of oil to the flame. In use, the upper edge of the central tube is heated until the tube becomes sufficiently hot to cause the oil within the tube to boil, thus becoming combustible and thereafter catching fire. Although the lamp adequately burns the oil to produce a flame, use of the lamp is limited. One such limitation is that the lamp can only use liquid fuels such as vegetable oils. Solid fuels such as solid paraffin, which tend to burn more cleanly and with less residue, may not be used with the design. In addition, when liquid fuels of different specific gravities are used, capsules of different masses must be employed to ensure that the oil surface is level with the top edge of the central tube.

Another prior art design is discussed in U.S. Pat. No. 1,184,511 issued May 23, 1916 to Henry J. Bourgeois. Similar to the Leynen-Hougaerts patent, this design uses liquid fuels to produce artificial light. In the Bourgeois design, a semi-rigid fibrous wick travels through a capillary tube centrally configured within an airtight float, the wick supplying fuel to the ignition area. To accommodate liquid fuels of different specific gravities, the capillary tube is longitudinally adjustable within the float, maintaining an ignition point sufficiently elevated above the surface of the fuel. As with the Leynen-Hougaerts patent, this design may only be used with liquid fuels; no provision is made for the combustion of solid fuel.

Yet another configuration is shown in U.S. Pat. Nos. 4,013,397 and 4,234,303 issued to Fernando M. Neugart on Mar. 22, 1977 and Nov. 18, 1980 respectively. In these patents, a combustion apparatus is disclosed which is configured to set atop the surface of a solid mass of fuel contained in a vessel. The combustion apparatus is formed of two plate members fabricated from a highly conductive metal which form a airtight compartment to provide buoyancy. Extending upwardly through an aperture in the center of the apparatus is a fibrous wick, in one embodiment supported by a thin support member. In use, the plate structure allows for the transfer of heat from the flame to the surface of the solidified fuel, thereby melting fuel, thus allowing the apparatus to float atop a shallow pool of molten fuel. The wick then draws from this pool of fuel maintaining a constant supply of fuel to the flame. While improving upon the state of the art, neither of these designs provide for adjustment of the flame intensity.

A lamp employing a wick support which has a metal, heat conducting ring and maintains a level of liquified wax at the same level as the ring is seen in U.S. Pat. No. 5,193,994, issued Mar. 16, 1994 to Hans-Ludwig Schirneker. The wick and support ride down upon a solid candle as the paraffin body of the candle is consumed and the device is not designed to be used interchangeably with either liquid or solid fuel.

None of the above inventions and patents, taken either singly or in combination, is seen to describe the instant invention as claimed.

SUMMARY OF THE INVENTION

The present invention is directed to a combustion apparatus for use with solid or liquid fuels. The apparatus includes a floatable combustion device which rests atop the surface of a mass of fuel such as solid paraffin or a quantity of liquid fuel such as liquid paraffin or vegetable oil, and contained within a fuel vessel. The combustion device employs a substantially conical top member and a bottom ballast member, each fabricated of a thermally conductive material such as copper, brass, or similar metal. Encased within the space defined by these two members is a conical wick, preferably in the form of a fiberglass mesh, which is supported by a substantially conical buoyant member which not only provides support to the wick within the combustion device but also assures that the device floats upon the fuel. To ensure close contact between the wick and the inside surface of the top member, the conical buoyant member is supported by an apertured center support plate fictionally fitted within the top member. Wedged between this central support plate and the ballast member is a rod arm member that has rod arm projections extending outward from the combustion device toward the vessel walls to maintain central alignment of the combustion device; use of the rod arm member and arms as just described is an optional feature.

Initially, the wick is saturated with an amount of either solid or liquid fuel. In use, flame is introduced to the portion of the wick extending from the combustion device, causing the fuel within the wick to boil and subsequently ignite. When liquid fuel is being utilized with the apparatus, the combustion device floats in the liquid due to the buoyancy created by the buoyant member. The wick, partially submerged in the fuel, constantly supplies the flame with fuel to be combusted. When solid fuel is being utilized, the combustion device is similarly placed atop the fuel and the saturated wick is ignited. Once a flame has burned for a short period of time, sufficient heat is transferred from the flame to the top member to the ballast member to cause a top layer of the surrounding fuel to melt. The combustion device then floats atop a shallow pool of liquid fuel, the wick drawing from this pool to keep the flame supplied with combustible fuel.

To adjust the intensity of the flame, the depth of submersion of the combustion device is altered. To adjust this depth, the combustion device is fitted with ballast members of various masses. The mass of the ballast member has a direct effect on the size of the flame created by the combustion device due to the amount of heat supplied to the fuel immediately before combustion. When a ballast of small mass is used, the device sits high in the liquid, and a substantial portion of the heat energy of the top member is transferred to the upper portion of the wick creating a large flame. On the other hand, a smaller flame is achieved when a ballast of larger mass is used, the top member being substantially submerged and transferring much of its energy to the surrounding fuel.

As a further optional feature, the very top of the wick support of the present invention may be fitted with any one of a number of ceramic material tops of various configurations, e.g., a torch, a dragon with an open mouth, a wizard with a flaming staff, etc. The flame is directed through the optional ceramic top and produces a decorative appearance of most any conceivable nature.

Accordingly, it is a principal object of the invention to provide a combustion apparatus that may be used to form a flame by utilizing solid or liquid fuels.

It is another object of the invention to provide a combustion device that may be adjusted to provide flames of various intensities.

It is a further object of the invention to provide a combustion device that is long lasting, the wick not needing to be replaced for several years of use.

Still another object of the invention is to provide a combustion device that is highly efficient, burning fuel at a very high temperature.

Yet a further object of the invention is to provide a combustion device that may be fitted with a ceramic top of predetermined configuration to provide an attractive flame emitting device.

It is yet another object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
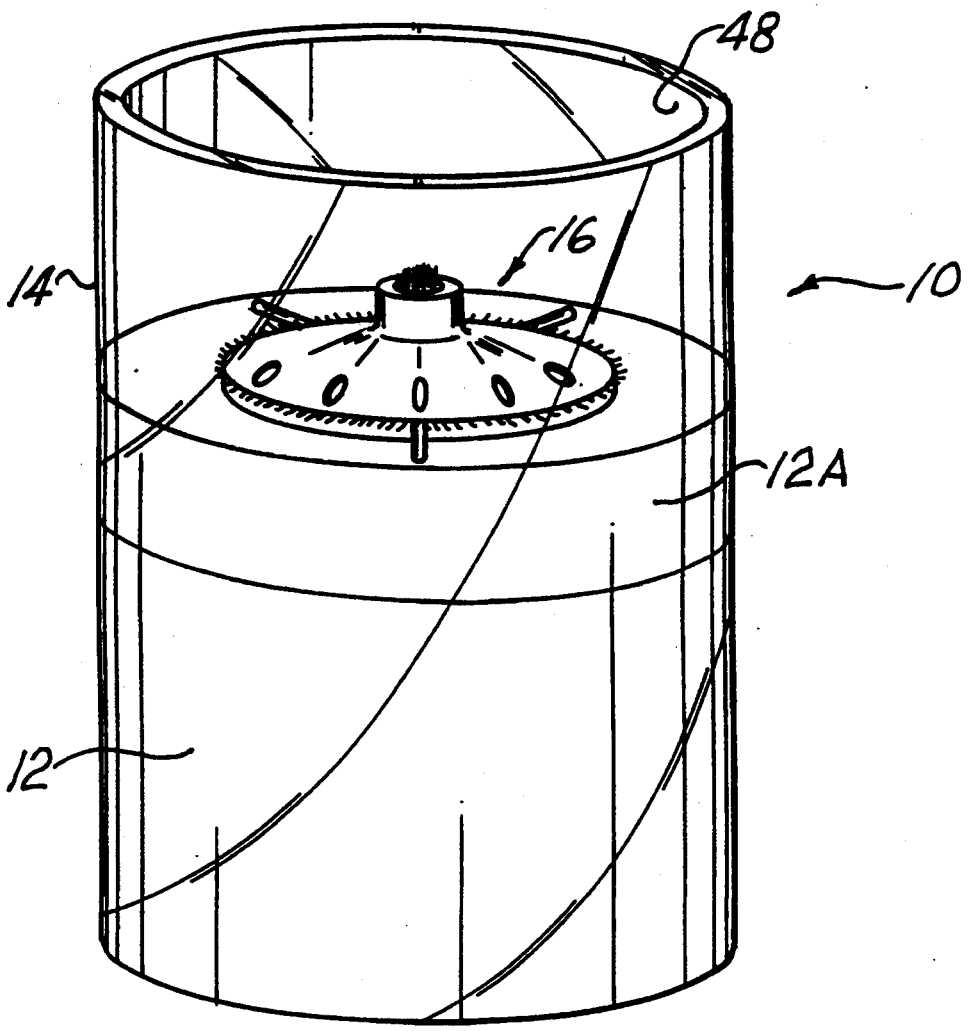
FIG. 1 is an environmental perspective view of the preferred embodiment.

Referring to the drawings, FIG. 1 shows the combustion apparatus 10 in preparation for use. An amount of combustible fuel 12 is contained within a vessel 14 fabricated of a clear material such as clear glass to allow for maximum dispersal of light. Positioned atop the fuel 12 is a combustion device 16 that provides for the combustion of the fuel 12 contained in the vessel 14.

Figure 2:
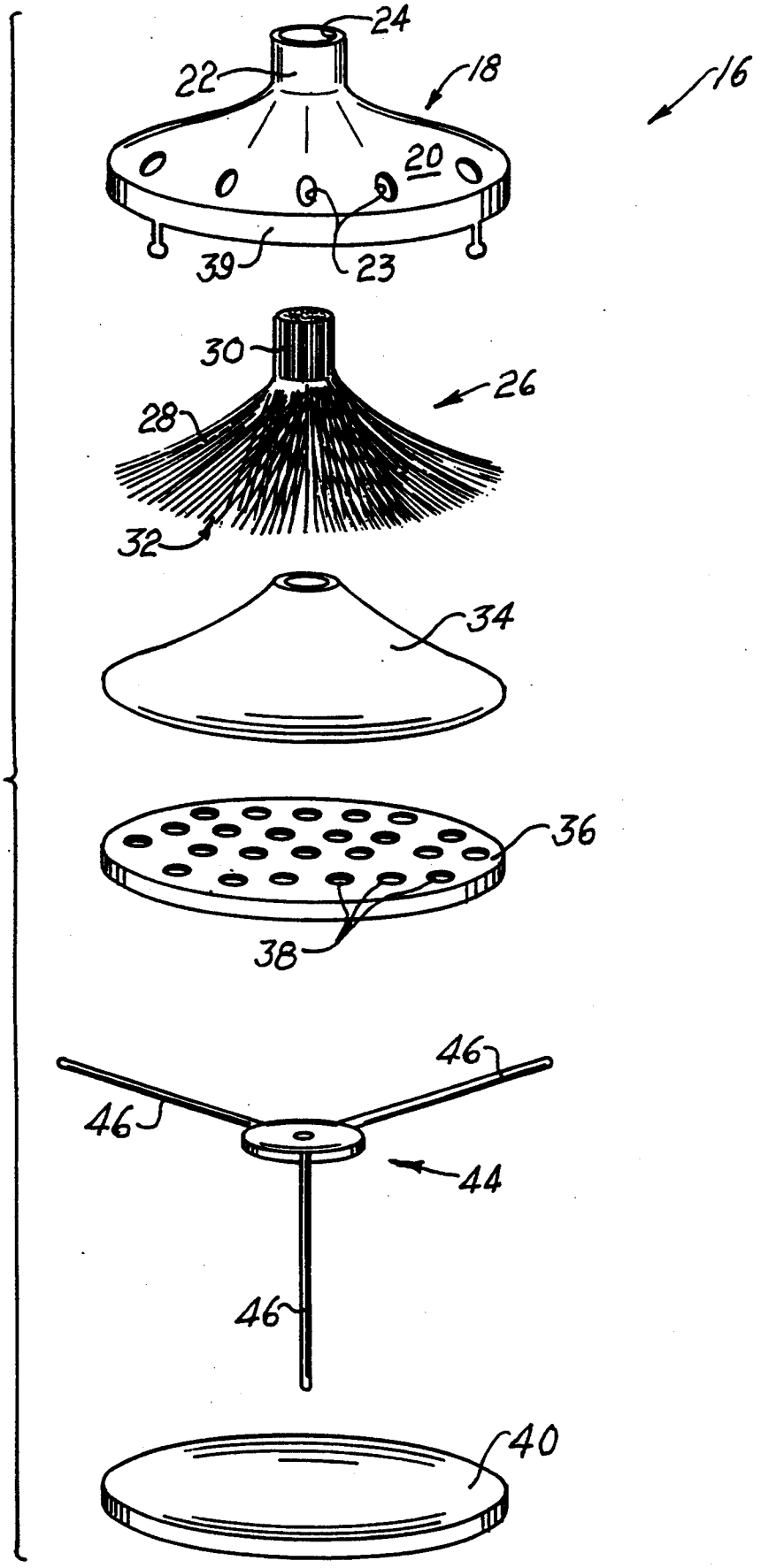
FIG. 2 is an exploded perspective view of the combustion device.
Figure 4:
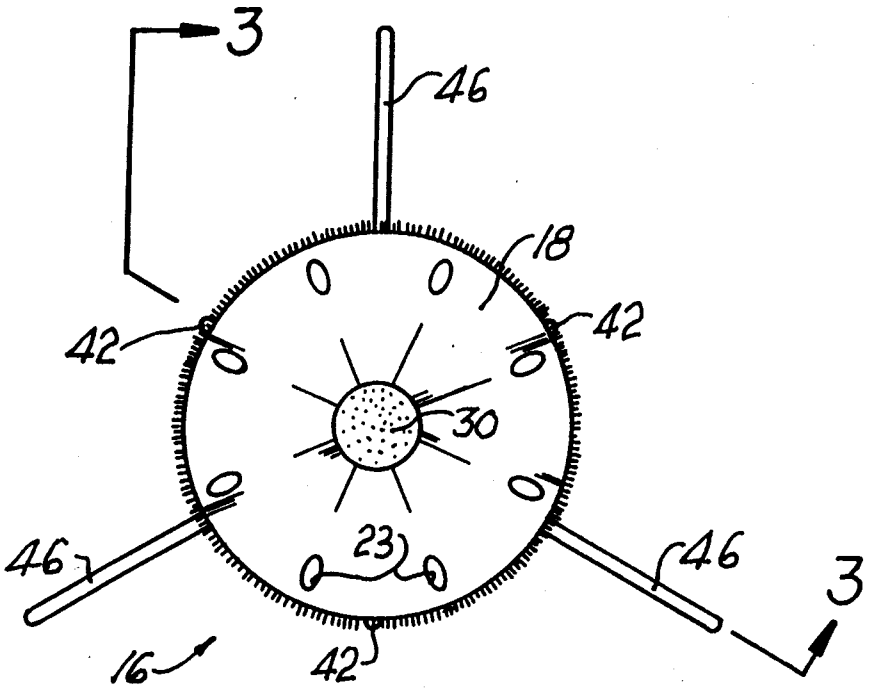
FIG. 4 is a top plan view of the combustion device.

As shown most clearly in FIG. 2, the combustion device 16 includes a top member 18. Preferably fabricated of a material of high thermal conductivity such as copper, brass, or similar metal, this top member 18 has a conical portion 20 and a neck portion 22. Defined through the conical portion 20 are a multiplicity of apertures 23 which aid in supplying the combustion device 16 with fuel 12. The neck portion 22 is cylindrical and defines an upper aperture 24 through which a portion of a wick 26 may extend. However, it is to be appreciated that this neck portion 22 could be in the form of a simulative figure to enhance the decorative appearance of the apparatus 10. The wick 26 is preferably a non-flammable weave such as fiberglass mesh and is configured in the form of a conical section 28 having a cylindrical section 30 such that the wick 26 is positioned in close proximity to the underside of the top member 18. Constructed of a non-flammable material, the wick 26 may be used for an extended duration of time without needing to be replaced.

Figure 3:
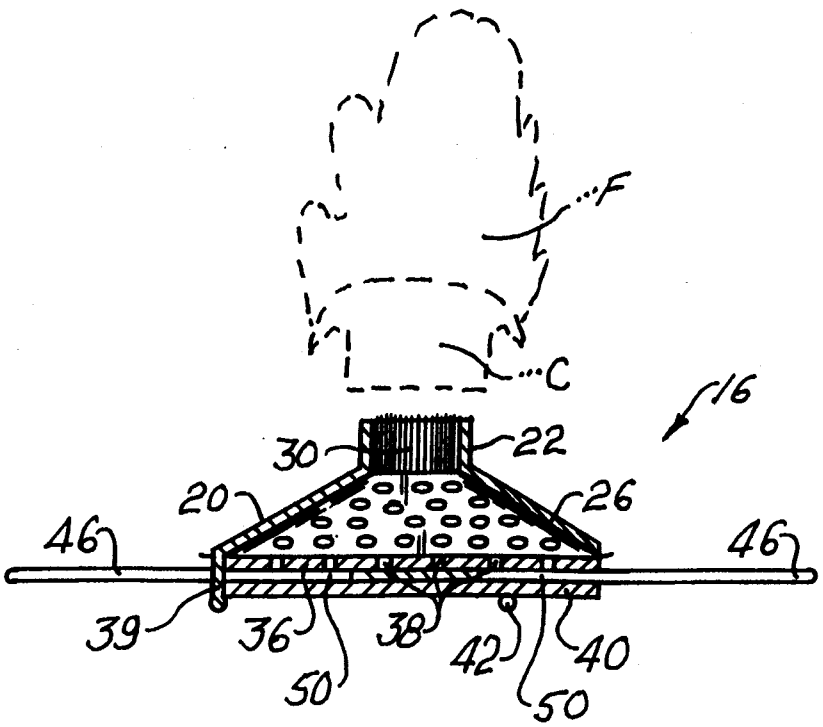
FIG. 3 is a cross-sectional side view of the combustion device.

As shown in both FIGS. 2 and 3, the conical section 28 of the wick 26 defines an open cavity 32 in which a conical buoyant member 34 is housed. This buoyant member 34 is constructed of a solid buoyant material such as cork or balsa wood or is constructed in the form of a hollowed airtight member fabricated from a thermally conductive material. In either configuration, the buoyant member 34 provides for floatation of the combustion device 12 when in use. The buoyant member 34 also performs a second function, maintaining close contact between the wick 26 and the top member 18. This close contact allows for more efficient heat transfer between the top member 18 and the wick 26. This allows for more efficient combustion due to the increased temperature of the fuel 12 immediately prior to combustion.

To maintain this proximate relation between the wick 26 and the top member 18, the conical buoyant member 34 is supported by a support plate 36 shown most clearly in FIG. 3. Also fabricated of a thermally conductive material, the support plate 26 has a multiplicity of apertures 38 defined therethrough that serve to increase the flow of fuel 12 to the wick 26. Frictionally fitted into a rim 39 of the top member 18, the support plate 36 secures the wick 26 and buoyant member 34 in place within the top member 18.

Fastened to the top member 18 beneath the support plate 34 is a ballast member 40. This ballast member 40 is fabricated of a thermally conductive material such as copper, brass, or similar metal and is snap fitted to the top member 18 with integral tabs 42 of the top member 18. In use, the ballast member 40 serves to stabilize the combustion apparatus 16, opposing the buoyancy of the buoyant member 34 and causing the combustion apparatus 16 to partially submerge into the fuel 12. Intermediate the support plate 36 and the ballast member 40 is a guide arm member 44 that has guide arm projections 46 that extend outward toward the vessel wall 48 (see FIG.

1) to maintain central alignment of the combustion device 16 during use. In addition to maintaining lateral alignment of the combustion device 16, the guide arm member 44 also functions as a spacer providing gaps 50 between the support plate 36 and the ballast member 40 (as shown in FIG. 3) that allow for increased supply of fuel 12 to the wick 26.

In use, the combustion device 16 is placed atop the surface of the fuel 12 be it solid or liquid. Open flame is then introduced to the wick 26. The wick 26, initially saturated with solid or liquid fuel, ignites immediately, the flame instantly boiling the fuel stored in the wick 26. Once this flame is ignited, the flame continues to burn the fuel contained in the wick, causing the neck portion 22 of the top member 18 to become hot. Constructed of a thermally conductive material, the top member 18 quickly transfers heat to the support plate 36 and the ballast member 40. With further reference to FIG. 1, when the combustion device 16 is being utilized with solid fuel such as solid paraffin, this heat energy is transferred to the underlying fuel 12, quickly beginning to melt it. As the solid fuel 12 melts, the combustion device 16 begins to float on a shallow layer of liquid fuel 12A (the depth of which is exaggerated in FIG. 1 for clarity of the view) with the wick 26 partially submerged. Once so floating, the combustion process is perpetuated, the wick 26 constantly supplying the flame with liquid fuel 12. As fuel 12 is continually combusted, the combustion device 16 travels slowly downward within the fuel vessel 14, straight travel of the device ensured with the guide arms 46.

Due to the substantially conical configuration of the combustion device 16, the wick 26, and thereby the fuel about to be combusted, is in contact with nearly the entire inside surface area of the top member 18. This arrangement allows for maximum heat transfer from the top member 18 to the fuel 12, thereby providing maximum combustion efficiency.

In use with liquid fuels such as liquid paraffin or vegetable oils, the combustion apparatus 10 functions in substantially the same way as when solid is being utilized, a portion of the combustion device 16 submerged in the fuel 12. When either solid or liquid fuel is used, various intensities of flame may be achieved by the implementation of ballast members 40 of various masses. When a ballast member 40 of greater mass is utilized, the submersion depth of the combustion device 16 is deep and a substantial amount of the heat energy within the top member 18 is transferred to the surrounding fuel 12 contained in the vessel 14. Accordingly, less heat energy is transferred to the fuel with the wick 26, thereby creating a smaller flame. Conversely, a large flame may be achieved when a ballast member 40 of lesser mass is utilized, thereby decreasing the submersion depth. In this configuration, a greater quantity of heat energy is transferred from the top member 18 directly to the wick 26, allowing for more efficient combustion and thus a larger flame. This feature of the invention allows the user to easily adjust the flame by simply changing the ballast member 40 fitted into the combustion device 16. While making such adjustments, the wick 26 and conical buoyancy member 34 are left undisturbed due to the support provided by the support plate 36 housed within the rim 39 of the top member 18.

As a further advantage of the present invention, the shape of the flame may be altered by adjusting the configuration of the wick 26. A standard, candle-like flame is produced when the wick 26 is left extending straight upward from the top member 18. However, the wick 26, being substantially deformable, may be flared outward about the upper aperture 24 of the top member 18 to create a spherical flame. This spherical shape increases the aesthetic appeal of the combustion apparatus creating a more decorative appearance. In a like manner, various other shapes may be achieved by the user with continued experimentation. As aforementioned, the decorative appearance may be further altered by the implementation of simulative, ceramic material figures integral with the top member 18 or, preferably, simply snap-fit onto the upper end of the top member 18. A simple example is indicated in FIG. 3 at C, producing an attractive spread, arcuate shaped flame F.

It is to be understood that the present invention is not limited to the embodiments described above, but encompasses any and all embodiments within the scope of the following claims.

I claim:

1. A combustion apparatus for use with solid or liquid fuels, said combustion apparatus comprising:

a floating combustion device, said combustion device having a top member and ballast member each fabricated of a thermally conductive material, said top member having a neck portion and a conical portion, said neck portion forming an aperture defined through said top member, said ballast member connecting to said top member to form a chamber therebetween, a substantially conical buoyant member housed within said chamber, said buoyant member dimensioned to fit within said chamber in close proximity to said top member, a wick substantially intermediate said buoyant member and said top member, a portion of said wick housed within said neck portion and thereby extending from said aperture of said top member; and a reservoir for holding said fuel.

2. The combustion apparatus of claim 1, further comprising a guide rod member, said guide rod member positioned between said top member and said ballast member, said guide rod member having several guide rods extending laterally whereby said rods serve to center said combustion device within said reservoir.

3. The combustion apparatus of claim 1, further comprising an apertured center support plate intermediate said buoyant member and said ballast member, said plate supporting said conical insert.

4. The combustion apparatus of claim 1, wherein said top member has a multiplicity of apertures formed through said conical portion.

5. The combustion apparatus of claim 1, there further being clip fasteners integral with said top member, said fasteners serving to connect said ballast member to said top member.

6. The combustion apparatus of claim 1, wherein said wick is a woven fiberglass mesh.

7. The combustion apparatus of claim 1, wherein said reservoir is transparent whereby light emitted from combustion of said fuel may pass through said reservoir.

8. The combustion apparatus of claim 1, there further being a ceramic wick portion supported in the top member opening which is attached to and in fluid communication with said wick.

9. A combustion apparatus for use with solid or liquid fuels, said combustion apparatus comprising:

a floating combustion device, said combustion device having a substantially conical top member and ballast member each fabricated of a thermally conductive material, said top member having an aperture defined therein, said ballast member connecting to said top member to form a chamber therebetween, a buoyant member contained within said chamber, there further being a wick supported by said buoyant member, said wick partially extending from said aperture of said top member;

said buoyant member being substantially conical, and being dimensioned to fit within said chamber in close proximity to said top member;

said wick being substantially fanned about said buoyant member intermediate said buoyant member and said top member such that said wick contacts said top member; and a reservoir for holding said fuel.

10. The combustion apparatus according to claim 9, wherein said top member further comprises a neck portion, said neck portion encompassing said aperture defined through said top member.

11. The combustion apparatus according to claim 9, further comprising a guide arm member, said guide arm member positioned between said top member and said ballast member, said guide arm member having a plurality of guide arm projections extending laterally whereby said arm projections serve to center said combustion device within said reservoir.

12. The combustion apparatus according to claim 9, wherein said top member has a plurality of apertures defined therethrough.

13. The combustion apparatus according to claim 9, there further being clip fasteners integral with said top member, said fasteners serving to connect said ballast member to said top member.

14. The combustion apparatus of claim 9, wherein said wick is a woven fiberglass mesh.

15. The combustion apparatus of claim 14, there further being a ceramic wick portion supported in the top member opening which is attached to and in fluid communication with said wick.

16. A combustion apparatus for use with solid or liquid fuels, said combustion apparatus comprising:

a floating combustion device, said combustion device having a substantially conical top member and ballast member each fabricated of a thermally conductive material, said top member having an aperture defined there, said ballast member connecting to said top member to form a chamber therebetween, a buoyant member contained within said chamber, there further being a wick supported by said buoyant member, said wick partially extending from said aperture of said top member;

said top member having a lower rim, there further being a support plate frictionally fit within said lower rim above said ballast member, said plate supporting said buoyant member and having a multiplicity of apertures formed therethrough; and a reservoir for holding said fuel.

* * * * *